United States Patent [19]

Moussie

[11] Patent Number: 4,931,754

[45] Date of Patent: Jun. 5, 1990

[54] FILTER UNIT FOR CONNECTORS HAVING FILTER CAPACITORS FORMED ON OPPOSING SURFACES OF A SUBSTRATE

[75] Inventor: Bob Moussie, Berlicum, Netherlands

[73] Assignee: E. I. Du Pont de Nemours and Company, Wilmington, Del.

[21] Appl. No.: 211,253

[22] Filed: Jun. 24, 1988

[30] Foreign Application Priority Data

Jul. 14, 1987 [NL] Netherlands ..... 8701661

[51] Int. Cl.[5] ..... H01R 13/648

[52] U.S. Cl. ..... 333/184; 333/185; 361/302; 361/309; 439/607; 439/620

[58] Field of Search ..... 333/182–185; 361/302, 328–330; 439/607, 620

[56] References Cited

U.S. PATENT DOCUMENTS

| | | | |
|---|---|---|---|
| 3,538,464 | 11/1970 | Walsh | 333/182 |
| 4,215,326 | 7/1980 | Hollyday | 333/182 |
| 4,407,552 | 10/1983 | Watanabe et al. | 333/182 X |
| 4,494,092 | 1/1985 | Griffin | 333/182 |
| 4,673,237 | 6/1987 | Wadsworth | 333/182 |
| 4,682,129 | 7/1987 | Bakermans et al. | 333/184 |
| 4,726,790 | 2/1988 | Hadjis | 333/185 X |
| 4,853,659 | 8/1989 | Kling | 333/184 |

FOREIGN PATENT DOCUMENTS

| | | |
|---|---|---|
| 0123457 | 10/1984 | European Pat. Off. . |
| 0124264 | 11/1984 | European Pat. Off. . |

OTHER PUBLICATIONS

Bootros, Kamal S., "A New Approach to the Design of EMI Filter Connectors Using Planar Filters"; 12th Am. Connector Symp. Proc.; Oct. 17, 18, 1979; pp. 222–226.

*Primary Examiner*—Eugene R. LaRoche
*Assistant Examiner*—Benny T. Lee
*Attorney, Agent, or Firm*—Thomas H. Magee

[57] ABSTRACT

Filter unit for connectors, comprising an electrically insulating substrate (2) with passages (3) for the contact elements of a connector, capacitors being disposed on both flat sides (4, 4') of the substrate (2) in the region of the passages (3), said capacitors made up of first electrodes, each formed by at least one layer (5, 5') of electrically conducting material extending over said sides (4, 4') of the substrate (2), and provided with correspondingly situated larger passages (6), second electrodes formed by spaced-apart electrode patches (9, 9') with passages (10) and at least one layer (7, 7') of dielectric material extending between said first and second electrodes. By connecting said second electrodes to the contact elements of a connector, and by connecting said first electrodes to the housing thereof, each contact element is capacitively decoupled. The invention further relates to a holder for mounting said filter unit to an assembled connector, a connector and an adaptor with an integrated filter unit.

19 Claims, 5 Drawing Sheets

FILTER UNIT FOR CONNECTORS HAVING FILTER CAPACITORS FORMED ON OPPOSING SURFACES OF A SUBSTRATE

BACKGROUND OF THE INVENTION

The invention relates to a filter unit for connectors, comprising a substrate of electrically insulating material which has two flat sides lying opposite each other and is provided with passages for the contact elements of the connector, capacitors being disposed on one flat side of the substrate in the region of one or more of the passages and being made up of first electrodes formed by at least one layer of electrically conducting material which extends over said side of the substrate and is provided with correspondingly situated larger passages, second electrodes formed by spaced-apart electrode patches of electrically conducting material which cover said passages of said substrate and can be connected to the contact elements of the connector, and at least one layer of dielectric material extending between the first and second electrodes in such a way that the passages are open.

A filter unit of this type is known from European Patent Application EP-A-123457.

In electrical transmission technology pulse-type signals are being used to an increasing extent for the transmission of data. As is known in electrical engineering, pulse-type signals can be broken down into a series of sinusoidal signals with increasing frequency, the so-called higher harmonics. In signals with a high pulse frequency, which are usual in computers, higher harmonics in the megahertz and even up to the gigahertz range can occur.

The steepness of the pulse edges, called the rise time, also plays an important role. A usual rise time of one nanosecond already corresponds to a higher harmonic frequency of about 350 MHz, irrespective of the pulse frequency itself.

These higher harmonics are found to cause great interference. In a room in which there are several interconnected electronic processing units producing pulse-type signals, the higher harmonics readily cause interference in the data processing. This interference can become so great that proper functioning of, for example, computers is no longer possible.

In order to keep the total interference level to a minimum, it is necessary to use filters by means of which the undesirable higher harmonic frequencies can be damped, without the desired data signal being deformed too much. A capacitor is a suitable element for this purpose, because the reactance thereof is inversely proportional to the frequency. This means that the reactance is greater for relatively low frequencies than for higher frequencies.

With the known filter unit each of the contact elements of a connector can be decoupled to earth by means of a capacitor. The filter unit is produced by the so-called thick film silkscreen printing technique on a flat substrate, so that capacitors with sufficiently low inductance can be produced cheaply for the effective damping of signals at high frequencies. The capacitance value of the flat capacitors thus formed is directly proportional to the surface area of the electrodes lying opposite and the relative dielectric constant of the dielectric between them, but is inversely proportional to the distance between the electrodes.

The disadvantage of the known filter unit is that the capacitance value of the filter capacitors formed therewith is limited by the space available on the one side of the substrate for the electrode patches surrounding the passages. The available surface area for an electrode patch is essentially determined here by the distance between the passages, which of course corresponds to the pitch of the connecting elements of the connector. For the arrow-shaped electrode patch of the known filter unit, the one pointed end of which surrounds the passage, while the other broad end extends towards the edge of the substrate, particularly with small pitches of the order of 2 mm and with more than two-row connectors, which are in great demand in the art, too little surface area is available to obtain that capacitance value which is necessary for good filtering.

SUMMARY OF THE INVENTION

The object of the invention is then to improve the known filter unit in such a way that filter capacitors with sufficiently high capacitance value can be provided also for connectors with relatively small pitch and/or for multiple row connectors. This is achieved according to the invention in that similarly constructed capacitors are disposed on the other opposite flat side of the substrate in the region of one or more of the passages. The electrode patches, which according to the invention are situated on either side of the substrate of the filter unit and which together with the first electrodes form the filter capacitors, can be arranged here in different ways relative to each other.

Another embodiment of the invention is to this end characterized in that the electrode patches situated on either side of the substrate are arranged in such a way that a passage on each side of the substrate is surrounded by electrode patches which can be connected to one and the same contact element of the connector. When a filter unit constructed in this way is connected to the contact elements of a connector, each contact element is decoupled by means of two parallel capacitors, the total decoupling capacitance value being equal to the sum of the capacitance values of the individual filter capacitors on either side of the substrate. It will be clear that in the case of, for example, connectors with a small pitch, electrode patches with a surface area equal to half the surface area of the electrode patches of the known filter unit will suffice to achieve the same decoupling capacitance value. With electrode patches with a surface area equal to that of the known filter unit, twice the decoupling capacitance value can be achieved with the filter unit according to the invention.

Instead of a symmetrical distribution of the electrode patches on both sides of the substrate, yet another embodiment of the filter unit according to the invention is characterized in that the electrode patches situated on either side of the substrate are arranged in such a way that a passage is surrounded by an electrode patch on only one side of the substrate. Arranging the electrode patches alternately on either side of the substrate means that there is sufficient space available on either side of the substrate to decouple the contact elements of, for example, three-row and four-row connectors by means of a filter capacitor of suitable size.

The known filter unit is constructed in such a way that the individual electrode patches and the at least one first electrode acting as earth electrode must be connected to the appropriate connector by means of soldered joints. In practice, this means that the filter unit and the connector are integral, as described in the above-mentioned European Patent Application EP-A-123457. Inter alia, from the cost point of view, this is a disadvantageous solution because both connectors with and connectors without filter unit have to be produced and held in stock.

A further object of the invention is therefore to produce an independent filter unit which can be mounted simply on a standard connector by means of a holder, it being possible to connect the earth electrodes of the filter unit electrically via the holder. Yet another embodiment of the filter unit according to the invention is for this purpose characterized in that the first electrodes situated on either side of the substrate extend along at least one narrow edge of the substrate.

Undesired electrical contact of the various electrode patches is prevented here through providing the capacitors on one and the other side of the substrate with a coating, in such a way that the first electrodes extending along the at least one narrow edge of the substrate are not coated.

With yet another embodiment of the filter unit according to the invention, which is characterized in that the holder is an oblong frame bounded by four sides and having stop elements against which the filter unit can rest, with locking elements for holding the filter unit in the holder and fastening means by means of which the holder can be mounted on a connector, a filter module which can be mounted as a separate unit on standard connectors is produced, so that each existing multiple-row connector can be extended in a simple manner quickly and cheaply by a filter unit to suppress the undesired, interfering higher harmonic frequencies.

Further, the invention relates to a connector and adaptor with an integrated filter unit as described above.

BRIEF DESCRIPTION OF THE DRAWINGS

The invention will be explained below in greater detail with reference to a number of examples of embodiments of the filter unit and a preferred embodiment of a holder for accomodation thereof, a connector and an adaptor provided with the filter unit.

FIG. 8*a* shows schematically in perspective an embodiment of an adaptor with an integrated filter unit according to the invention, in an exploded view.

FIG. 8*b* shows schematically on an enlarged scale a cross section through the assembled adaptor according to FIG. 8*a*.

DETAILED DESCRIPTION OF THE INVENTION

Figure 1:
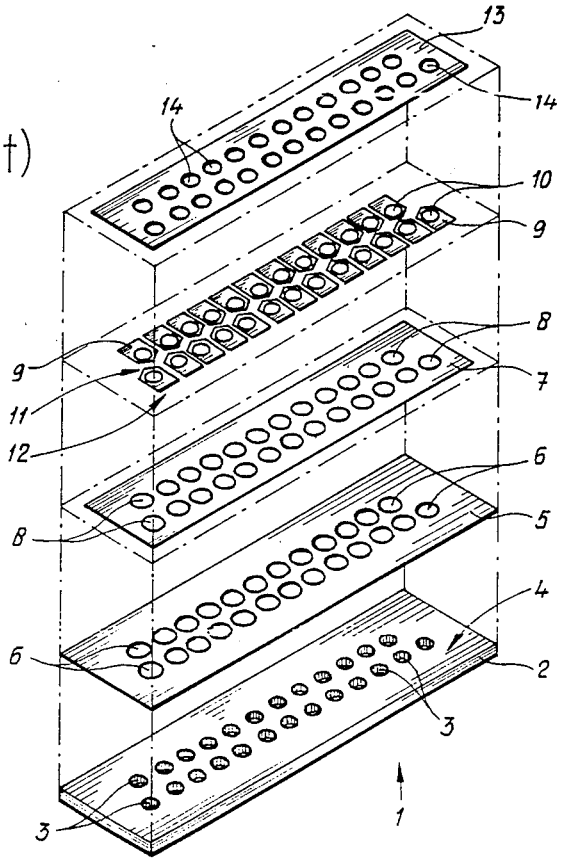
Fig-1 (Prior Art)
FIG. 1 shows in perspective an embodiment of the known filter unit in an exploded view.

FIG. 1 shows layer by layer the construction of an embodiment of the known filter unit 1. The flat substrate 2 has passages 3 which are spaced in such a way that the filter unit is suitable for mounting in a two-row connector. A first electrode 5 consisting of a layer of electrically conducting material is disposed over the substrate side 4, having passages 6 which are situated corresponding to the passages 3 in the substrate 2. The passages 6 are of greater diameter than the passages 3 of the substrate 2. A layer 7 of dielectric material having correspondingly placed passages 8 is disposed on the first electrode 5. The diameter of these passages is preferably equal to or slightly larger than the diameter of the passages 3 in the substrate 2. Electrode patches 9 of electrically conducting material with a passage 10 are disposed on the layer 7 and together with the first electrode 5 and the dielectric layer 7 form the filter capacitors. The electrode patches 9 are arrow-shaped, the pointed end 11 enclosing the passage 10, and the broad end 12 extending towards an edge of the substrate 2. With the position of the electrode patches 9 shown, a filter unit for a two-row connector with a relatively small pitch of the order of magnitude of 2 mm can be produced. Although not necessary, the electrode patches 9 can extend along the wall of the passages 3 of the substrate 2. A coating 13 of dielectric material is provided on the electrode patches 9, the openings 14 of said coating being of such dimensions that the filter unit can be disposed over the contact elements of a connector. In the assembled state the electrode patches 9 can be connected here by means of soldering to the contact elements of the connector and the first electrode 5 is soldered fast to the connector housing.

Figure 2:
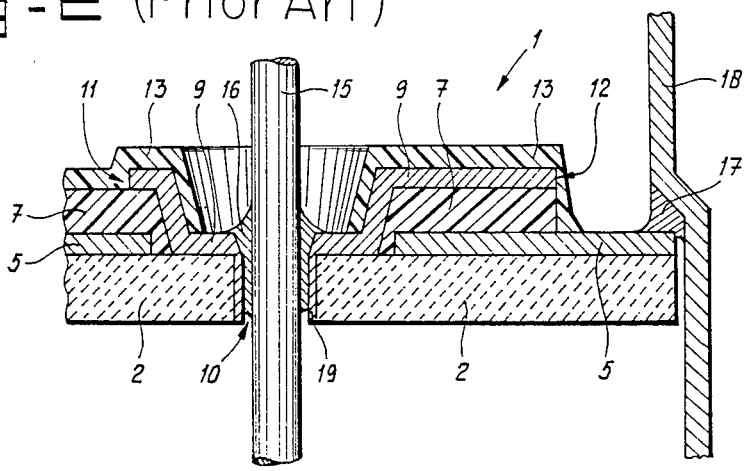
Fig-2 (Prior Art)
FIG. 2 shows on an enlarged scale a cross section through a single electrode patch of the filter unit shown in FIG. 1 connected to a connector.

FIG. 2 shows on an enlarged scale a cross section through an electrode patch 9 of the filter unit 1 shown in FIG. 1, connected to a connector, viewed from the narrow edge of the substrate 2. A part 19 of the electrode patch extends along the wall of the passage 3 of the substrate 2. The passage 10 bounded hereby contains a connecting pin 15 of the connector. The connecting pin 15 is connected by means of solder 16 to the electrode patch 9. The first electrode 5 is connected by means of solder 17 to a wall 18 of the housing of the connector.

The substrate 2 of the filter unit is preferably of aluminium oxide ($Al_2O_3$), the capacitor electrodes of an alloy of palladium and silver, and the dielectric of barium titanate ($BaTiO_3$). Several different dielectric layers or partial layers can, of course, be used instead of a single dielectric layer 7, and several coating layers 13 can also be used. The position of the capacitor electrodes 5, 9 can also be changed relative to each other from the structure shown in FIG. 1.

Figure 3:
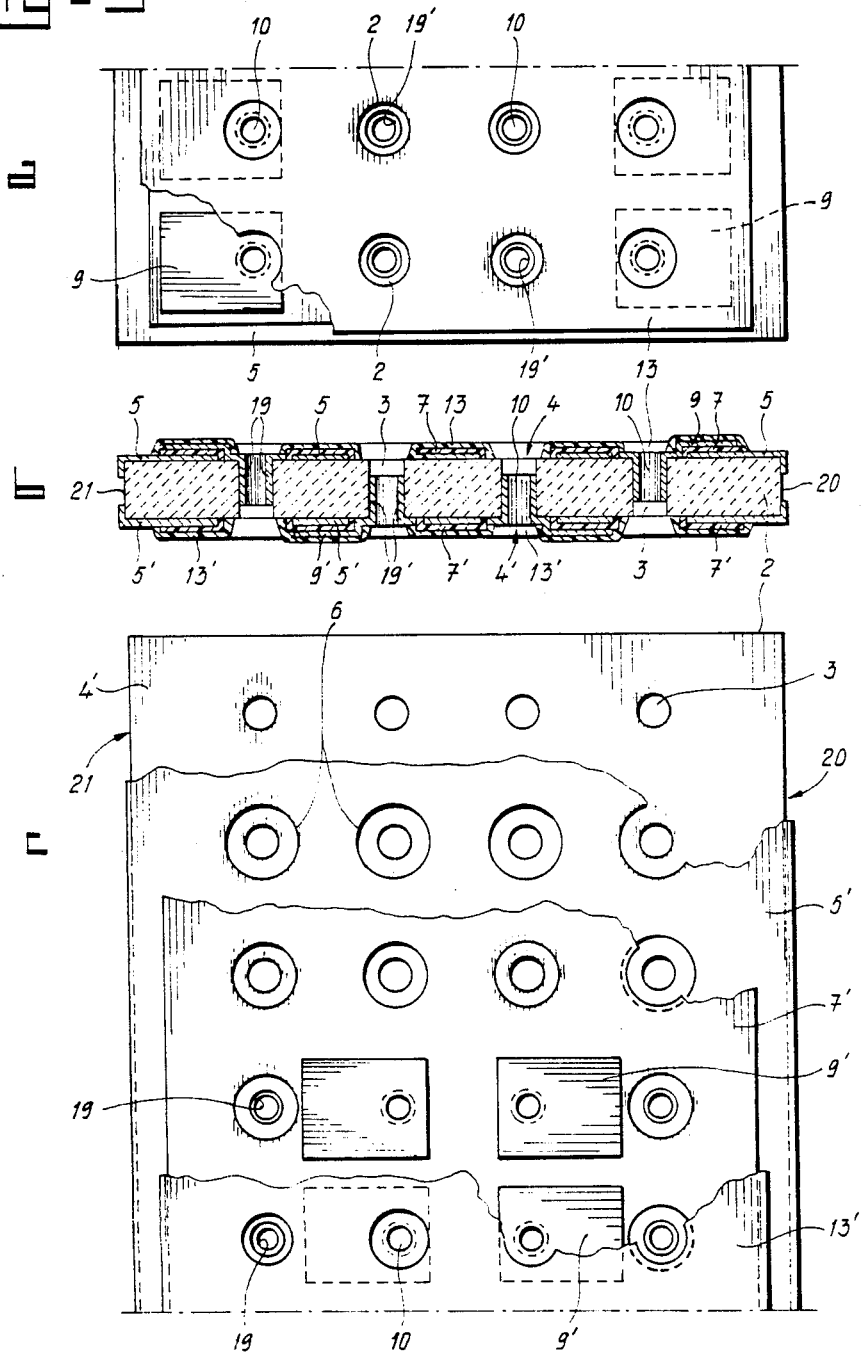
FIGS. 3*a*–3*c* show schematically different views and a cross section of an embodiment of the filter unit according to the invention for use in a four-row connector.

Based on the filter construction shown in FIG. 1, FIG. 3 shows the construction of an embodiment of the filter unit according to the invention for use in a four-row connector, in which capacitors are formed on both flat sides of the substrate of the filter unit. In FIG. 3 the layers and elements corresponding to the known filter unit according to FIG. 1 are indicated by the same reference number. The corresponding layers and elements situated on the opposite flat side of the substrate are also indicated by the same reference numbers, but provided with an apostrophe. FIG. 3*b* shows a cross section similar to that of FIG. 2, while FIG. 3*a* shows a view with cutaway parts of the one flat side and FIG. 3*c* of the other flat side of the filter unit according to the invention.

The electrode patches 9, 9' on either side of the substrate 2 are arranged in such a way that the electrode patches 9 belonging to the two outer rows of passages are disposed on the one side 4 and the electrode patches 9' belonging to the two inner rows of passages are disposed on the other side 4' of the substrate. Each passage 3 of the substrate 2 is thus enclosed only on one side of the substrate by an electrode patch 9, 9'. The parts 19, 19' of the electrode patches 9, 9' extending along the wall of the passages are of such length that they do not make electrical contact with the electrodes of the capacitors situated on the opposite side of the substrate.

Figure 5:
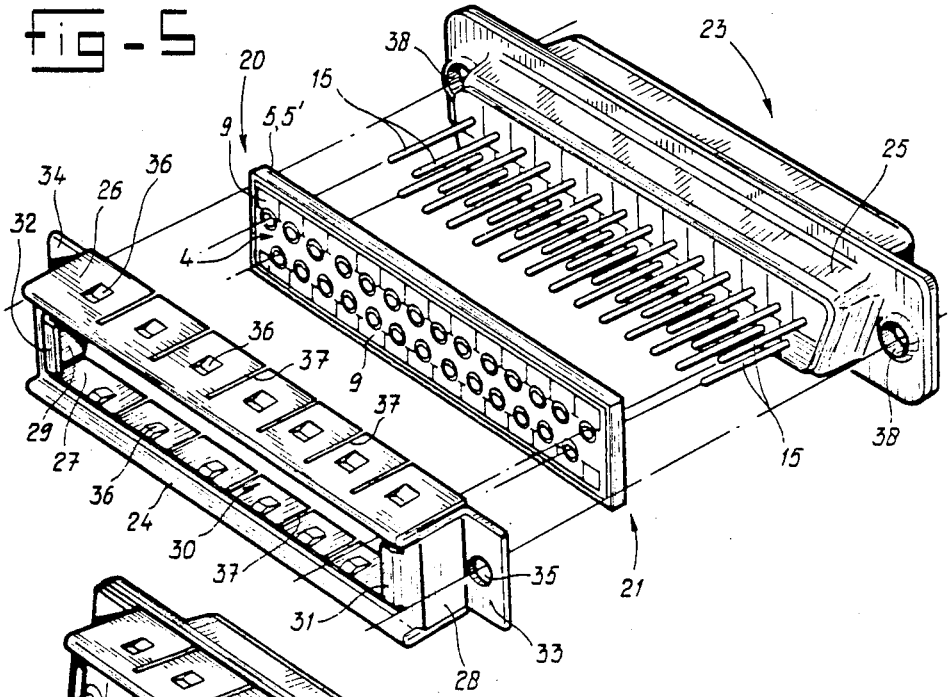
FIG. 5 shows in perspective the mounting according to the invention of the filter unit on a standard connector by means of a holder.

The first two electrodes 5, 5' extend partially along the narrow edges 20, 21 in the lengthwise direction of the substrate and are not coated with a coating layer 13. The purpose of this will become clear later when FIG. 5 is being discussed.

The electrode patches 9, 9' can be arranged in ways differing from that of FIG. 3. The electrode patches belonging to the passages situated adjacent in a row or column can be disposed, for example, always on another side of the substrate. In the case of a substrate which is provided with at least two rows of passages the electrode patches belonging to the passages of a row or column can be situated on one side of the substrate and the electrode patches belonging to another, for example, adjacent row or column can be situated on the other side of the substrate.

It can be seen clearly from the views of the four-row filter unit according to the invention shown in FIGS. 3*a* and 3*c* that there is sufficient space on both sides of the substrate for fitting electrode patches for the production of filter capacitors of suitable size, comparable with those of the known two-row filter unit shown in FIG. 1. Inter alia, as a result of the efforts towards miniaturization, and due to the great density of the present integrated circuits, there is a great demand for connectors with a high contact element density, in other words, with a large number of contact elements per unit volume. The filter unit according to the invention can be advantageously used for connectors of this type.

Figure 4:
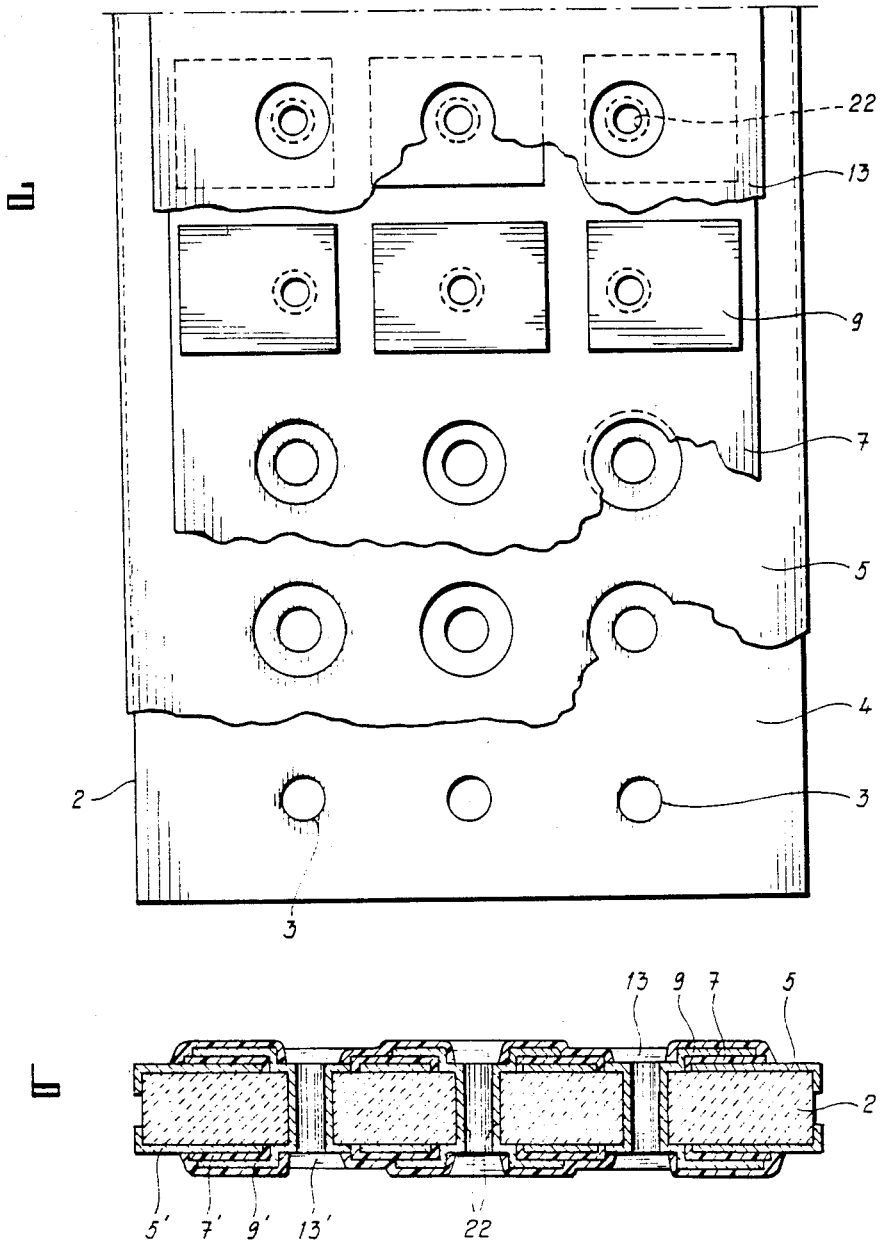
FIGS. 4*a*–4*b* show schematically a view and cross section of an embodiment of the filter unit according to the invention which is suitable for use in a three-row connector.

FIGS. 4*a*–4*b* show in a similar manner to that of FIG. 3 a view and cross section of the construction of an embodiment of the filter unit according to the invention for a three-row connector, in which each passage 3 is surrounded on either side of the substrate 2 by an electrode patch 9, 9'. Compared with the known filter unit of FIG. 1, the electrode patches 9, 9', situated on either side of the substrate and belonging to a particular passage, can have such a surface area that they achieve at least the capacitance value of the filter capacitors of the known filter unit. Since for this purpose each individual electrode patch 9, 9' need have only half the area of the electrode patches of the known filter unit, the passages 3 can be disposed in the substrate with relatively small pitch. Although not directly necessary, the electrode patches 9, 9' belonging to a particular passage and situated on either side of the substrate are directly connected to each other electrically via a continuous metallisation 22 extending along the wall of the passage 3. The filter unit shown in FIG. 4 corresponds in structure to the filter unit shown in FIG. 3. The rows of passages can be placed staggered relative to each other in the direction of the row.

Although rectangular electrode patches are shown in the above embodiments of the filter unit according to the invention, electrodes of another geometrical periphery can also be used, for example, round, square, hectagonal electrode patches etc. Instead of round passages, it is, of course, also possible to use slot-shaped, square or other cross sections, depending on the shape of the connecting elements of the connector.

Although the first electrodes 5, 5' in FIGS. 3 and 4 are shown on either side of the substrate as a single layer, they can, of course, also be in several partial layers extending over part of a substrate side 4, 4' to at least one edge of the substrate 2.

FIG. 5 shows a standard connector 23, over the connecting pins 15 of which the filter unit according to the invention can be fitted. The individual electrode patches 9, 9' of the filter unit, which in FIG. 5 are only shown schematically, can be connected by, for example, soldering to the connecting pins 15 of the connector. The first electrodes 5, 5' of the filter unit extending along the edges 20, 21 of the substrate 2 are now connected by means of a holder 24 of electrically conducting material to the housing 25 of the connector.

The holder 24 is to this end designed as an oblong open frame bounded by four sides 26, 27, 28, 29, which can be made as a whole of one piece of electrically conducting material. From the narrow sides 28, 29 of the frame opening 30 extend two lip-type stop elements 31, 32, against which the filter unit rests when fitted. Also extending outwards from the narrow sides 28, 29 in the lengthwise direction of the holder 24 are two fastening lips 33, 34, which are each provided with a fastening hole 35 for fastening the holder 24 on the connector 23.

The holder 24 is also provided on the long sides 26, 27 of the frame with projections 36 projecting inwards into the container, which in the embodiment shown in FIG. 5 are formed as V-shaped lips in the sides 26, 27 of the frame of the container. The sides 26, 27 of the frame are also provided with a number of incisions 37, in order to improve the clamping action between the holder 24 and the filter unit according to the invention. The projections 36 are situated at such a distance from the frame opening 30 that when the filter unit is placed in the holder, said filter unit is confined between the lips 31, 32 acting as stop elements and the projections 36 acting as locking means, in such a way that good electrical contact of the first electrodes 5, 5' with the holder 24 is ensured.

Figure 6:
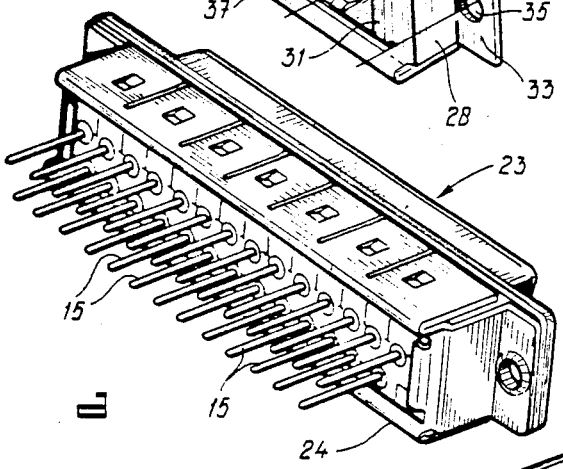
FIGS. 6*a*–6*b* show in perspective two embodiments of a connector with a filter unit with holder mounted thereon, as shown in FIG. 5.
Figure 6:
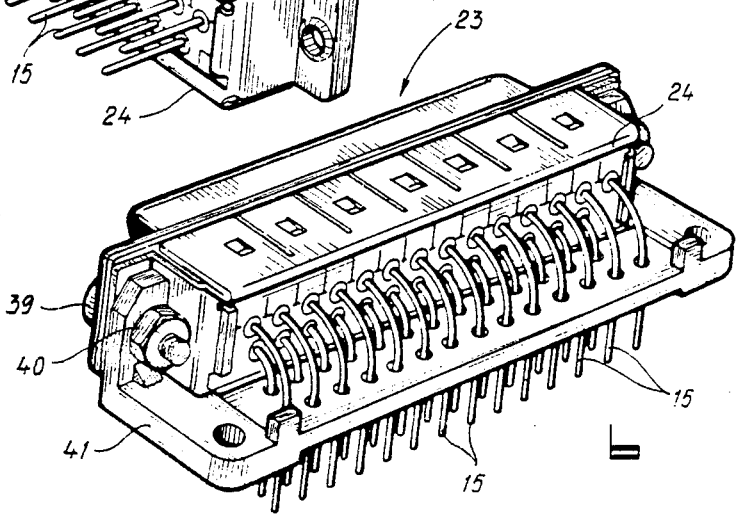

The dimensions of the holder 24 are such that it can be slid together with the filter unit over the connecting side of the connector 23, in such a way that the fastening holes 35, 38 of the holder and the connector respectively coincide. A filter unit according to the invention with the holder according to the invention mounted on a connector is shown in FIG. 6*a*. The connecting pins 15 can be connected, for example, to a printed circuit board or by means of so-called wirewrap connections to electronic circuits.

FIG. 6*b* shows a connector 23 provided with a filter unit and holder 24 according to the invention, in which the whole unit is mounted by means of a screw 39 and nut 40 on a carrier 41, through which the connecting pins 15 of the connector are passed. A connector constructed in this way is suitable for, for example, mounting at right angles on a printed circuit board (not shown).

Instead of the lips 31, 32 and projections 36 shown in FIG. 5, the filter unit, in particular the electrodes 5, 5' extending along one or more of the edges of the substrate, can also be connected by, for example, soldering to the holder 24, in order to produce a good electrical contact of the first electrodes 5, 5' of the filter unit and the holder 24. With the holder and the filter unit according to the invention, a so-called filter module is produced and can be mounted as a separate unit on standard connectors. Virtually any existing multiple-row connector can be extended herewith in a simple manner quickly and cheaply to form a so-called filter connector.

Figures 6, 7, 8:
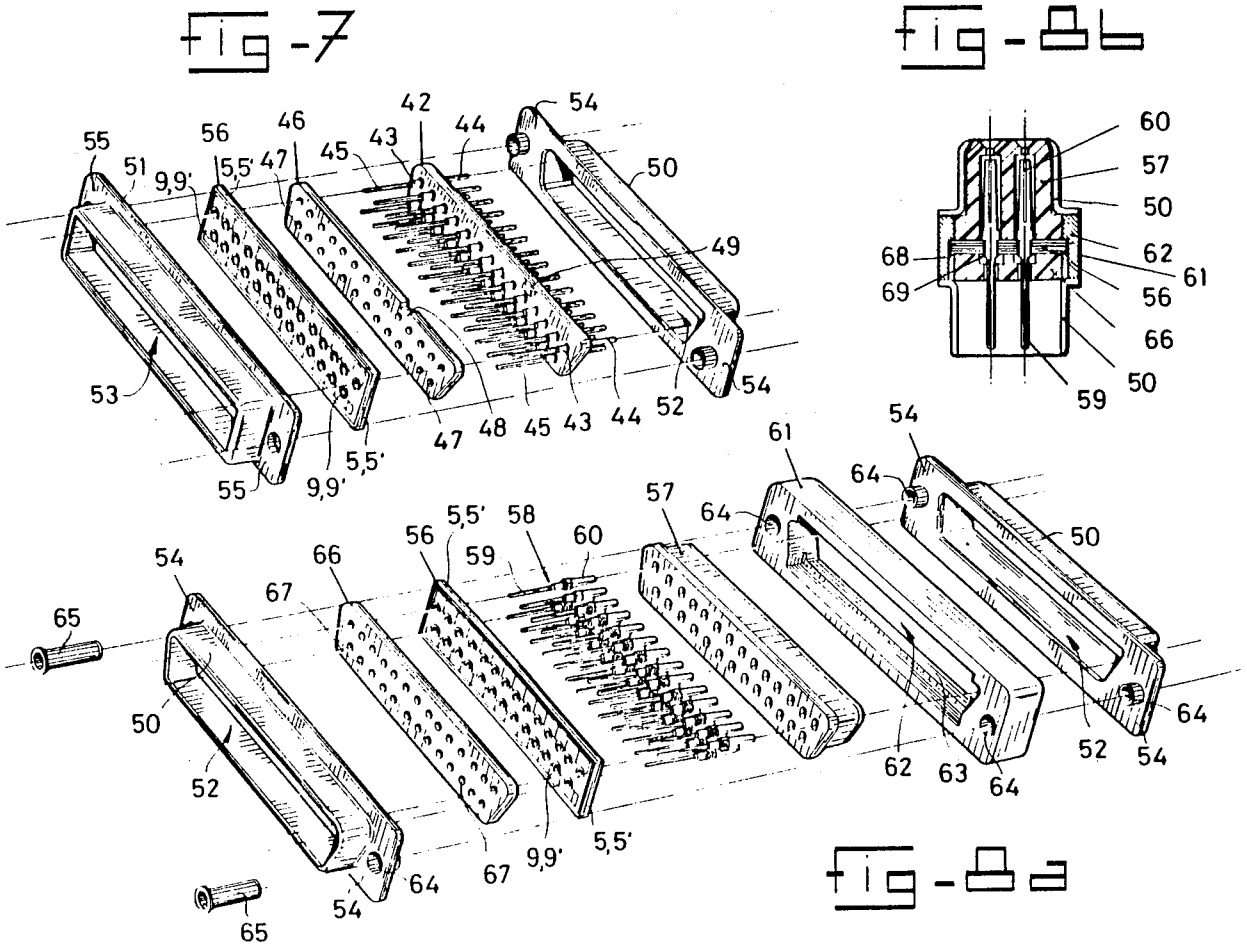
FIG. 7 shows schematically in perspective an embodiment of a connector with an integrated filter unit according to the invention, in an exploded view.

FIG. 7 shows in perspective a standard so-called D-SUB type connector, in an exploded view, comprising an oblong body 42 of electrically insulating material, supporting a plurality of contact elements 43. The contact elements 43 each have a pin shaped contact end 44 for contacting a further connector (not shown) and a pin shaped connecting end 45 for the connection of an electrical wiring, e.g. a printed wiring. Instead of a pin shaped contact end, the contact elements 43 may have socket shaped contact ends (not shown).

For reasons of dimensioning, the connector comprises a spacer 46 of electrically insulating material, having passages 47 which are situated correspondingly to the arrangement of the contact elements 43. Said spacer 46 slidably accomodates the connecting pins 45, and is provided with a notch 48, which corresponds to a boss 49 on the face of the supporting body 42 facing said spacer 46. Further, the connector comprises an oblong housing of electrically conducting material, consisting of a first oblong shell 50 and a second oblong shell 51, with openings 52, 53 for receiving the contact ends and connecting ends of the contact elements, respectively.

Said first and second shells are provided with fastening lips 54, 55 respectively, extending outwards in the lengthwise direction of a shell, for riveted connection of said shells. Between the spacer 46 and the second shell 51, a filter unit 56 according to the present invention is mounted.

In assembling the connector, the first electrodes 5, 5' of said filter unit 56, extending along the edges thereof, are soldered to the second shell 51. This assembly, together with the spacer 46, is fitted over the connecting pins 45 of the contact elements 43, and the electrode patches 9, 9' of said filter unit 56 are soldered to the connecting pins 45. In this way, the contact elements are fixed to the filter unit 56 and the second shell 51. Lastly, the first shell 50 is mounted over the contact pins 44 and rivetingly connected to the second shell 51. With said first and second shell and the filter unit, a connector shielded for a broad range of frequencies is obtained.

FIG. 8*a* shows in exploded view an embodiment of an adaptor with a filter unit according to the invention. This adaptor can be used as a filter assembly for connectors not provided with filtered contact elements, or for a further enhancement of the filter action of a connector already provided with filtered contact elements. The embodiment shown is especially suited for the D-SUB type connector, as for example shown in FIGS. 5, 6 and 7.

The adaptor comprises an oblong block shaped body 57 of electrically insulating material, supporting a plurality of contact elements 58. These contact elements 58 each have a pin shaped contact end 59, for contacting a first connector, (not shown), and a socket shaped contact end 60, for contacting a second connector (not shown) Instead of a pin shaped and a socket shaped contact end, the contact elements 58 may either have only socket shaped contact ends or only pin shaped contact ends (not shown).

In the embodiment shown, the adaptor further comprises an oblong supporting body 61 of electrically conducting material, with an oblong opening 62 for receiving the supporting body 57 with the contact elements 58. In said opening 62 a raised edge 63 is formed, acting as a stop for the filter unit 56 to be mounted over the pin shaped contact ends 59. The first electrodes 5, 5' extending along the edges of said filter unit 56 are soldered to the raised edge 63 of said supporting body 61. The electrode patches 9, 9' are soldered to the respective contact elements 58. The assembly thus formed, is confined between a first and second identical oblong shell 50, with an oblong opening 52 for receiving the contact ends 59, 60 of the contact elements 58.

Said first and second shell 50 are provided with fastening lips 54, extending outwards in the lengthwise direction of the shell, and each provided with a hole 64. On his the narrow sides of the supporting body 61, the supporting body 61 is provided with correspondingly located holes 64, for fastening the shells with hollow rivets 65 to the supporting body 61. Of course, other suited fastening means may be used in assembling the adaptor. For reasons of dimensioning the adaptor comprises a spacer 66 of electrically insulating material with passages 67, correspondingly located to said contact elements 58.

FIG. 8*b* shows schematically, on an enlarged scale, a cross section through the assembled adaptor according to FIG. 8*a*. With solder joints 68 the first electrodes 5, 5' of the filter unit are connected to the supporting body 61, and with solder joints 69 the contact elements of the adapter are connected to the respective electrode patches 9, 9' of the filter unit 56. The electrically conducting supporting body 61 together with the conducting shells 50 provide for an effective shielding of the contact elements for low frequencies, and with said filter unit 56 a filter adaptor for a broad range of frequencies is obtained.

The filter unit, holder, connector and adaptor are, of course, not limited to the embodiments indicated in the description and figures, but can be modified and added to in many ways, without going beyond the scope of the invention. For example, it is also possible to use semiconducting layers and/or electrode patches for forming combinations of resistors (R) and capacitors (C), the so-called RC filters. Structures consisting of a middle electrode acting as an earth electrode, having on either side thereof electrode patches separated by one or more dielectric layers can, for example, also be provided on each side of the substrate, in order to increase the filter capacity even further.

I claim:

1. In combination a filter unit and a connector having a plurality of electrically conducting contact elements, wherein said filter unit comprises a substrate of electrically insulating material which has two flat sides lying opposite each other joined by narrow edges and is provided with passages having connecting walls between said flat sides through which the contact elements of the connector pass, capacitors being disposed on one flat side of the substrate in the region of one or more of the passages, said capacitors being made up of first electrodes formed by at least one layer of electrically conducting material which extends over said one flat side of the substrate and is provided with correspondingly situated electrode passages which are larger than the passages of said substrate, second electrodes formed by spaced-apart electrode patches of electrically conducting material which cover said passages of said substrate and are connected to the contact elements of the connector, and at least one layer of dielectric material extending between the first and second electrodes in such a way that the passages of said substrate are open, the filter unit further comprising capacitors disposed on the other opposite flat side of the substrate in the region of one or more of the passages, said capacitors on the opposite side having first and second electrodes constructed similar to corresponding first and second electrodes of said capacitors on the one side, wherein the electrode patches situated on both sides of the substrate are arranged in such a way that any particular passage is surrounded by an electrode patch on only one of the flat sides of the substrate, said connector comprising an electrically conducting housing, said housing enclosing an electrically insulating body supporting said contact elements, each contact element having a contact end for contacting further connector, and a connecting end for the connection of an electrical wiring, said filter unit being mounted on the housing of said connector at the side where the connecting ends of the contact elements are located, the first and second electrodes of said filter unit being connected to the housing and the connecting ends of the contact elements, respectively.

2. A filter unit in combination with an adaptor having a plurality of electrically conducting contact elements, wherein said filter unit comprises a substrate of electrically insulating material which has two flat sides lying opposite each other joined by narrow edges and is provided with passages having connecting walls between said flat sides through which the contact elements of the adaptor pass, capacitors being disposed on one flat side of the substrate in the region of one or more of the passages, said capacitors being made up of first electrodes formed by at least one layer of electrically conducting material which extends over said one flat side of the substrate and is provided with correspondingly situated electrode passages which are larger than the passages of said substrate, second electrodes formed by spaced-apart electrode patches of electrically conducting material which cover said passages of said substrate and are connected to the contact elements of the adaptor, and at least one layer of dielectric material extending between the first and second electrodes in such a way that the passages of said substrate are open, the filter unit further comprising capacitors disposed on the other opposite flat side of the substrate in the region of one or more of the passages, said capacitors on the opposite side having first and second electrodes constructed similar to corresponding first and second electrodes of said capacitors on the one side, wherein the electrode patches situated on both sides of the substrate are arranged in such a way that any particular passage is surrounded by an electrode patch on only one of the flat sides of the substrate, said adaptor comprising an electrically conducting housing, an electrically insulating body supporting said contact elements, each contact element having a first and second contact end for contacting a first and second connector respectively, said housing enclosing said filter unit, the first and second electrodes of said filter unit being connected to the housing and contact elements, respectively.

3. A filter unit in combination with an adaptor according to claim 2, in which the housing of said adaptor is comprised of a first and second oblong shell, with an electrically conducting oblong further supporting body, having an opening for receiving the insulating supporting body with the contact elements, said further supporting body is mounted between and connected with said first and second shell, and the first electrodes of said filter unit are connected to said further supporting body.

4. A filter unit for a connector having one or more contact elements, comprising a substrate of electrically insulating material which has two flat sides lying opposite each other joined by narrow edges and is provided with passages having connecting walls between said flat sides for the contact elements of the connector, capacitors being disposed on one flat side of the substrate in the region of one or more of the passages, said capacitors being made up of first electrodes formed by at least one layer of electrically conducting material which extends over said one flat side of the substrate and is provided with correspondingly situated electrode passages which are larger than the passages of said substrate, second electrodes formed by spaced-apart electrode patches of electrically conducting material which cover said passages of said substrate and can be connected to the contact elements of the connector, and at least one layer of dielectric material extending between the first and second electrodes in such a way that the passages of said substrate are open, the filter unit further comprising capacitors disposed on the other opposite flat side of the substrate in the region of one or more of the passages, said capacitors on the opposite side having first and second electrodes constructed similar to corresponding first and second electrodes of said capacitors on the one side, wherein the electrode patches situated on both sides of the substrate are arranged in such a way that any particular passage is surrounded by an electrode patch on only one of the flat sides of the substrate.

5. A filter unit according to claim 4, wherein the electrode patches on both flat sides extend along the wall of the passage, wherein the electrode patches extend over such a distance in the passage that they make no electrical contact with the electrodes on the opposite side of the substrate.

6. A filter unit according to claim 4 provided with several rows of passages, said rows arranged along the flat sides of said substrate, wherein the electrode patches belonging to the passages in one row and an adjacent row are always on opposite sides of the substrate.

7. A filter unit according to claim 4, wherein the substrate is provided with at least two rows of passages, said rows arranged along the flat sides of said substrate, and wherein the electrode patches belonging to the passages of one row are situated at one side of the substrate, and the electrode patches belonging to another row are situated at the other side of the substrate.

8. A filter unit according to claim 7, wherein the substrate is provided with three rows of passages, in which the electrode patches belonging to the passages of the middle row are situated at one side of the substrate, and the electrode patches belonging to the outermost rows are situated at the other side of the substrate.

9. A filter unit according to claim 7, wherein the substrate is provided with four rows of passages, the electrode patches belonging to the passages of the two outermost rows being situated at one side of the substrate, and the electrode patches belonging to the passages of the two innermost rows being situated at the other side of the substrate.

10. A filter unit according to claim 4 wherein the first electrodes situated on either side of the substrate extend along at least one narrow edge of the substrate.

11. A filter unit according to claim 10, wherein the capacitors situated at one side of the substrate are coated with at least a first additional coating of dielectric material, and wherein the capacitors situated at the other side of the substrate are coated with at least a second additional dielectric coating, while the first electrodes extending along the at least one narrow edge of the substrate are not coated.

12. A filter unit for a connector having one or more contact elements, comprising a substrate of electrically insulating material which has two flat sides lying opposite each other joined by narrow edges and is provided with passages having connecting walls between said flat sides for the contact elements of the connector, capacitors being disposed on one flat side of the substrate in the region of one or more of the passages, said capacitors being made up of first electrodes formed by at least one layer of electrically conducting material which extends over said one flat side of the substrate and is provided with correspondingly situated electrode passages which are larger than the passages of said substrate, second electrodes formed by spaced-apart electrode patches of electrically conducting material which cover said passages of said substrate and can be connected to the contact elements of the connector, and at least one layer of dielectric material extending between the first and second electrodes in such a way that the passages of said substrate are open, the filter unit further comprising capacitors disposed on the other opposite flat side of the substrate in the region in one or more of the passages, said capacitors on the opposite side having first and second electrodes constructed similar to corresponding first and second electrodes of said capacitors on the one side, wherein the electrode patches situated on both sides of the substrate ar arranged in such a way that any particular passage is surrounded by an electrode patch on only one of the flat sides of the substrate, in combination with a holder of electrically conducting material connected to the first electrodes of said filter unit disposed therein, the first electrodes situated on either side of the substrate extending along at least one narrow edge of the substrate, said holder formed in such a way that the passages of said substrate for passing through the contact elements of the connector are free and the first electrodes extending along the at least one narrow edge of the substrate make electrical contact with the holder.

13. A filter unit in combination with a holder according to claim 12, wherein the holder is an oblong frame bounded by two narrow and two long sides that define a frame opening and having stop elements against which the filter unit rests, with locking means for retaining the filter unit in the holder and fastening means for mounting the holder on a connector.

14. A filter unit in combination with a holder according to claim 13, wherein the stop elements consist of two lips projecting from the narrow sides of the frame into the frame opening.

15. A filter unit in combination with a holder according to claim 14 wherein the locking means consist of several projections projecting inwards from the sides of the frame, and positioned in such a way that the filter unit disposed within said holder is confined between the stop elements and the projections.

16. A filter unit in combination with a holder according to claim 15, wherein the projections consist of V-shaped lips formed in the long sides of the frame, and wherein the long sides of the frame are further provided with incisions from the frame opening at the end opposite said stop elements, in order to improve the clamping action of the holder, in such a way that a reliable, good electrical contact is produced between the first electrodes of the filter unit and the holder.

17. A filter unit in combination with a holder according to claim 15 wherein the sides of the frame are at such a distance from each other that the holder fits over the connection side of a connector of standard dimensions.

18. A filter unit in combination with a holder according to claim 17, wherein the holder is provided on the narrow sides with lips projecting outwards in the lengthwise direction thereof and having a fastening hole, for connecting the holder to the connector.

19. In combination a filter unit, a holder and a connector, wherein said connector comprises an electrically conducting housing, said housing enclosing a supporting body of electrically insulating material, provided with a plurality of electrically conducting contact elements, each contact element having a contact end for contacting a further connector, and a connecting end for the connection of an electrical wiring, said filter unit and said holder being mounted on the housing of said connector from the side where the connecting ends of the contact elements are located, said filter unit comprising a substrate of electrically insulating material which has two flat sides lying opposite each other joined by narrow edges and is provided with passages having connecting walls between said flat sides through which the contact elements of the connector pass, capacitors being disposed on one flat side of the substrate in the region of one or more of the passages, said capacitors being made up of first electrodes formed by at last one layer of electrically conducting material which extends over said one flat side of the substrate and is provided with correspondingly situated electrode passages which are larger than the passages of said substrate, second electrodes formed by spaced-apart electrode patches of electrically conducting material which cover said passages of said substrate and are connected to the contact elements of the connector, and at least one layer of dielectric material extending between the first and second electrodes in such a way that the passages of said substrate are open, the filter unit further comprising capacitors disposed on the other opposite flat side of the substrate in the region of one or more of the passages, said capacitors on the opposite side having first and second electrodes constructed similar to corresponding first and second electrodes of said capacitors on the one side, wherein the electrode patches situated on both sides of the substrate are arranged in such a way that any particular passage is surrounded by an electrode patch on only one of the flat sides of the substrate, said holder comprising electrically conducting material connected to the first electrodes of said filter unit disposed therein, the first electrodes situated on either side of the substrate extending along at least one narrow edge of the substrate, said holder formed in such a way that the contact elements of the connector pass through the passages of said substrate and the first electrodes extending along the at least one narrow edge of the substrate make electrical contact with the holder.

* * * * *